US005463883A

United States Patent [19]

Pellerin et al.

[11] Patent Number: 5,463,883

[45] Date of Patent: Nov. 7, 1995

[54] TEXTILE TREATING MACHINE

[75] Inventors: James W. Pellerin, Metairie; Russell H. Poy, Destrehan; Edward J. Bradley, New Orleans, all of La.

[73] Assignee: Pellerin Milnor Corporation, Kenner, La.

[21] Appl. No.: 344,352

[22] Filed: Nov. 22, 1994

[51] Int. Cl.[6] ..... D06F 37/22

[52] U.S. Cl. ..... 68/140; 34/601; 277/9

[58] Field of Search ..... 68/140; 34/601; 277/9; 384/542

[56] References Cited

U.S. PATENT DOCUMENTS

| | | | |
|---|---|---|---|
| 1,562,019 | 11/1925 | Wilkinson . | |
| 1,925,662 | 9/1933 | Hume | 68/140 |
| 2,636,754 | 4/1953 | Baudry . | |
| 2,688,520 | 9/1954 | Covington . | |
| 2,931,505 | 4/1960 | Winslow | 68/140 X |
| 2,963,892 | 12/1960 | Edwards | 68/140 |
| 3,199,318 | 8/1965 | Sullivan et al. | 68/140 |
| 3,270,529 | 9/1966 | Engel | 68/140 X |
| 3,613,406 | 10/1971 | Toth | 68/140 |
| 3,854,732 | 12/1974 | Franz et al. | 277/58 |
| 4,448,425 | 5/1984 | von Bergen | 277/34 |
| 4,835,993 | 6/1989 | Dreher | 68/142 |
| 5,105,636 | 4/1992 | Anastase et al. | 68/140 |

*Primary Examiner*—Philip R. Coe

*Attorney, Agent, or Firm*—Vaden, Eickenroht, Thompson & Feather

[57] ABSTRACT

There is disclosed a textile treating machine having an outer shell in which textile treating liquids may be contained, and a perforated drum for receiving textiles to be treated and having a shaft extending through an opening in one end of the shell. A bearing assembly is mounted on the other side of the shell and supports the shaft for extension through it so that the shaft and drum may be rotated to cause treatment liquid to be circulated through the textiles, and a seal assembly is releasably connected to the shell to sealably surround the shaft adjacent the shell opening inboard of the bearing assembly so as to prevent leakage of the liquid from the shell into the bearing assembly. The shaft includes a main section which extends through the seal and bearing assemblies and a bushing which is releasably connected over a tapered inner end of the main shaft section, and the drum has an opening in one end which surrounds the inner end of the shaft and is of a size to pass the seal assembly therethrough. The connections of the bushing to the main shaft section and to the drum and the seal assembly to the shell are accessible from within the drum to permit them to be replaced through access openings in other ends of the shell and drum without removable of either of the bearing housing or the main shaft section.

2 Claims, 3 Drawing Sheets

TEXTILE TREATING MACHINE

This invention relates to improvements in textile treating machines of the type in which the treatment liquid is caused to circulate through the textiles during rotation of a drum in which the textiles are received. In one of its aspects, it relates to an improved machine of this type in which the textiles are received within a perforated drum which is rotated within a shell in which the liquid is contained. Typically, the textiles are clothes, and the treatment liquid is a washing detergent.

In conventional machines of this latter type, a shaft on one end of the drum extends through an opening in the adjacent end of the shell, and the shaft is supported by a bearing assembly mounted on the shell outwardly of its one end. More particularly, an assembly is also mounted on the shell to sealably surround the shaft inboard of the bearing assembly and thereby prevent leakage of liquid from the shell into the bearing assembly. Frequently, liquid which might leak past the seal assembly is drained through suitable holes intermediate the bearing and seal assemblies. The shaft is rotated by a suitable pulley outboard of the bearing assembly, and access openings in the opposite ends of the shell and drum permit the textiles to be loaded into or removed from the drum.

The seal rings of the sealing assembly become worn and thus require relatively frequent replacement. This has required, in prior machines of this type, that either the shaft be released from the drum to permit the shaft and bearing assembly to be removed from the shell, as in a machine of this type heretofore marketed by the assignee of the present application, or the bearing assembly be released from the shell and separated from the shaft to permit access to the seal assembly, as shown and described in U. S. Pat. No. 5,105,636.

In either case, the procedure is difficult and time-consuming due, among other things, to the size and weights of the parts to be moved. It is therefore the primary object of this invention is to provide a machine of this type which overcomes those and other problems, and, more particularly, such a machine in which the seal assembly may be replaced without either removing the shaft and bearing assembly from the shell or releasing and separating the bearing assembly from the shaft.

These and other objects are accomplished by a textile treating machine of the type described comprising a drum for receiving textiles to be treated and having a shaft which is supported for rotation by a bearing assembly mounted on a frame, means for so rotating the shaft and thus the drum to cause a treatment liquid to be circulated through the textiles, and a seal assembly releasably connected to the frame and including at least one seal ring sealably surrounding the shaft inboard of the bearing assembly. The drum has an opening in one end surrounding the shaft which is of a size to pass the seal assembly therethrough, and the shaft includes a main section which extends through the seal and bearing assemblies and a bushing releasably connected over a tapered inner end of the main section of the shaft and to the drum. More particularly, the drum has an access opening in its other end, and the connections of the bushing to the main shaft section and drum and the seal assembly to the frame are accessible from within the drum to permit them to be removed from the opening in the one end of the drum, whereby the seal assembly may be replaced through the access opening in the other end of the drum without removal of either of the bearing assembly or main shaft section.

In the illustrated and preferred embodiment of the invention, the frame comprises an outer shell in which textile treating liquid may be contained and the drum is perforated and rotatable within the shell to permit the treatment liquid to be circulated through the textiles. More particularly, the seal assembly is releasably connected to the shell, and the shell has an access opening in its other end aligned with the access opening in the drum through which the seal assembly may be replaced.

In the drawings, wherein like reference characters are used throughout to designate like parts:

Figure 1:
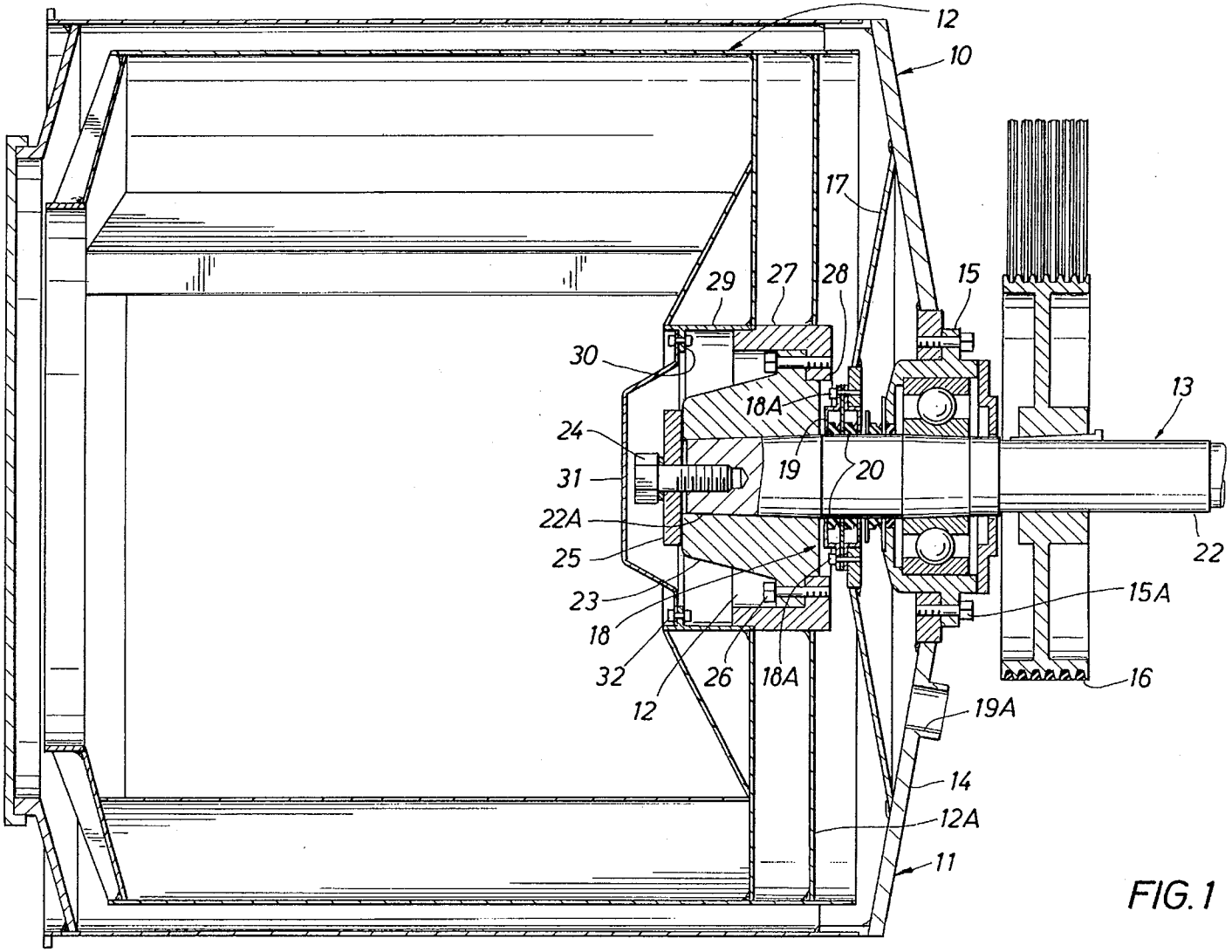
FIG. 1 is a longitudinal section view of a machine constructed in accordance with the present invention.

With reference now to the details of the above described drawings, the overall machine, which is indicated in FIG. 1 by the reference 10, comprises an outer shell or housing 11 and a drum 12 mounted on a shaft 13 extending through the end wall 14 of the shell for rotation within the shell. As shown, both the shell and drum are of cylindrical shape and the drum is supported concentrically within the shell.

The shaft is rotatably supported by a conventional bearing assembly 15 releasably mounted on the shell. As shown, the bearing assembly includes a housing which is releasably connected to the end wall of the shell by bolts 15A accessible from the outer side of the shell. The shaft is rotated by a suitable motor connected to a pulley 16 disposed about the shaft outwardly of the bearing assembly and may also be mounted in an outer bearing assembly (not shown) outboard of the pulley.

The drum 12 also has an end wall 12A which faces the end wall 14 of the shell, and access openings are formed in the opposite ends of the shell and drum to permit textiles to be treated to be moved into and out of the interior of the drum. These access openings are adapted to be opened and closed by suitable closures.

In the illustrated machine, at least the outer peripheral wall of the drum is perforated so that a treatment liquid contained in the shell may be circulated through the textiles in the drum as the drum is rotated within the shell. As well-known in the art, ribs are preferably formed on the inner side of the peripheral wall of the drum to agitate the textiles during rotation. As previously noted, the machine may be used for treating textiles in various ways, such as washing, in which case the treatment liquid would be a detergent.

The shell also has an inner wall 17 secured on the inner side of the end wall 14, and a seal assembly 18 is mounted on the inner wall 17 in position to sealably surround the shaft 13 inboard of the bearing assembly. Although the seal assembly is intended to prevent treatment liquid from leaking past it and into the bearing assembly, ports 19A are nevertheless formed in the end wall 14 to permit liquid to be drained therefrom in the event leakage does occur.

The seal assembly 18 is of any suitable construction and thus, as shown, includes an annular carrier 19 in which seal rings 20 are contained. As shown, the carrier has two chambers each for receiving a seal ring 20, and each of the seal rings has radially outwardly facing lips which tightly engage with the opposite sides of the chambers.

The carrier of the seal assembly is releasably connected to the inner wall 17 of the shell adjacent to the end wall 12A of the drum by means of bolts 18A which are accessible from the inside of the drum. As shown, the carrier of the seal assembly is made up of a central wall and angled side walls, all of which are secured by means of the bolts 18A.

As previously described, the shaft 13 includes a main section 22 which extends through the seal and bearing assemblies and to which the pulley 16 is attached and a bushing 23 releasably connected to the inner end of the shaft 13 as well as to the drum. More particularly, the bushing fits closely over a tapered inner end 22A of the main shaft section 22 and is releasably and tightly held thereon by means of a bolt 24 extending through a plate 25 across the inner ends of the shaft section and the bushing. The bolt is threadly connected to the end of the main section so as to permit the bushing to be drawn tightly onto the inner end of the main shaft section.

As shown, a ring 27 and an inward extension 29 thereof are mounted on the drum to form an opening through its one end. The ring has an inner flange 28 and the bushing is releasably connected to the drum by bolts 26 extending through the flange and accessible from within the drum. The inner end of the drum is closed by a cover 31 which is removably connected to a flange 30 on the inner end of the extension 29 by bolts 32 accessible from inside the drum.

Figure 3:
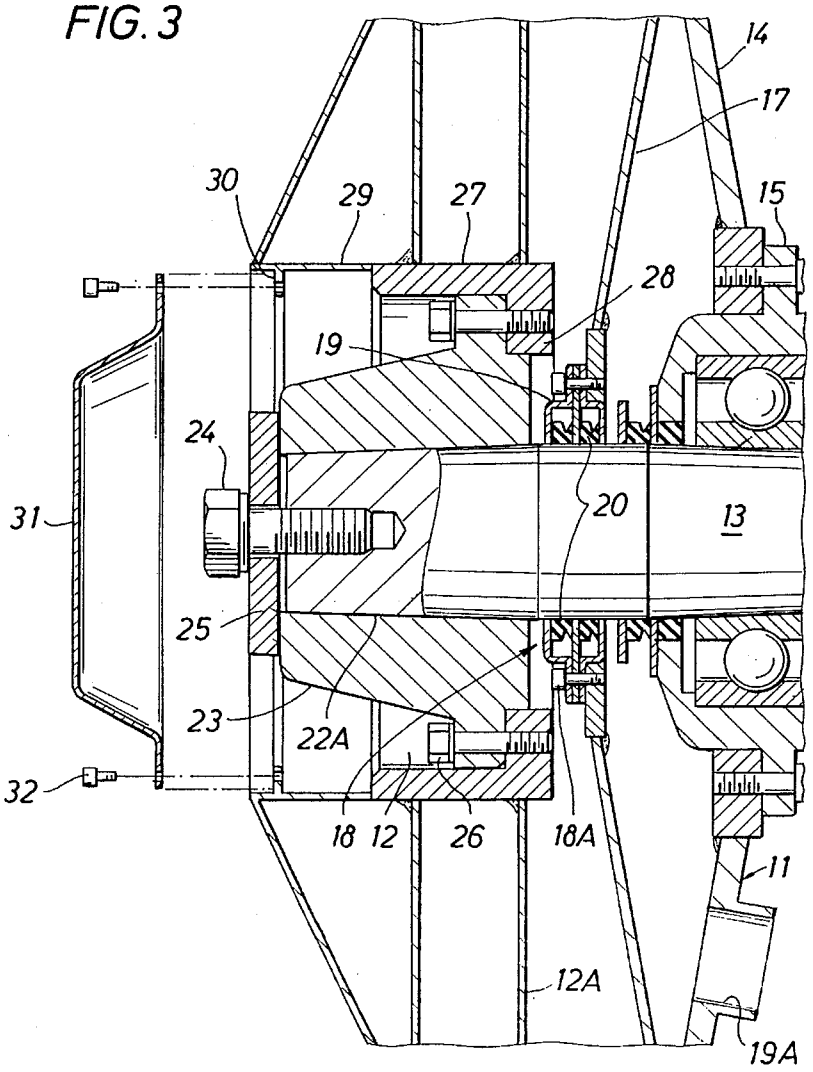
FIG. 3 is a view similar to FIG. 2, but upon release of a cover from connection to the drum at the inner end of the opening through the right-hand end of the drum.
Figure 2:
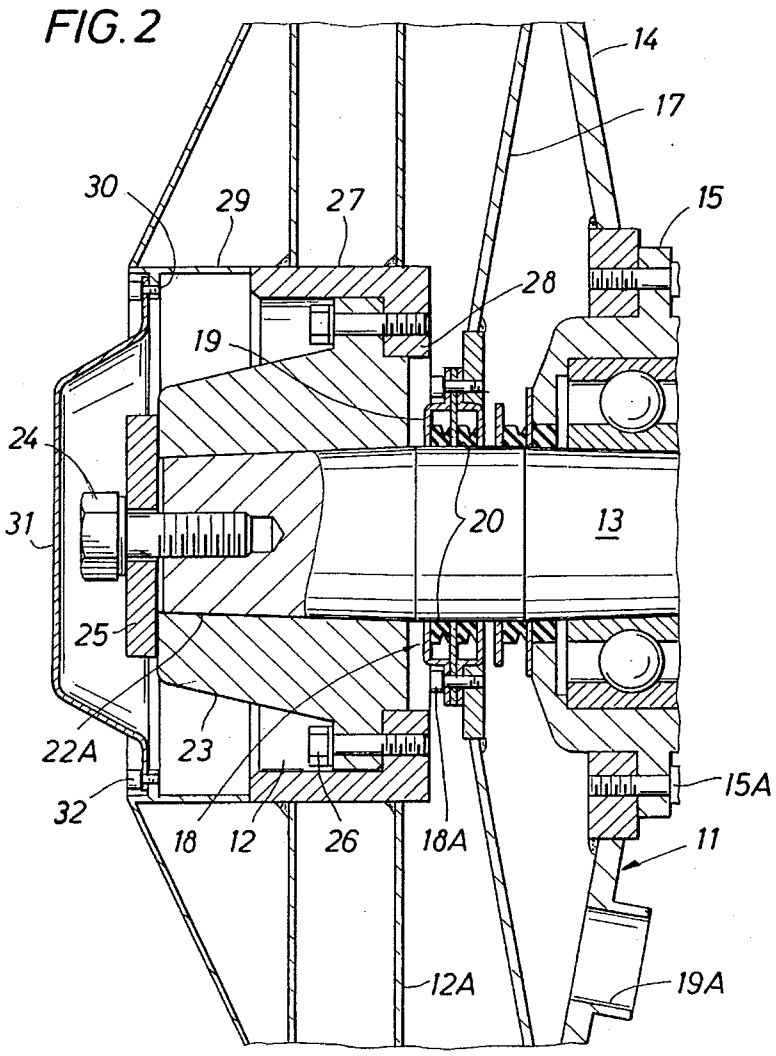
FIG. 2 is an enlarged longitudinal section view of a portion of the right-hand end of the machine, as shown in FIG. 1.
Figure 4:
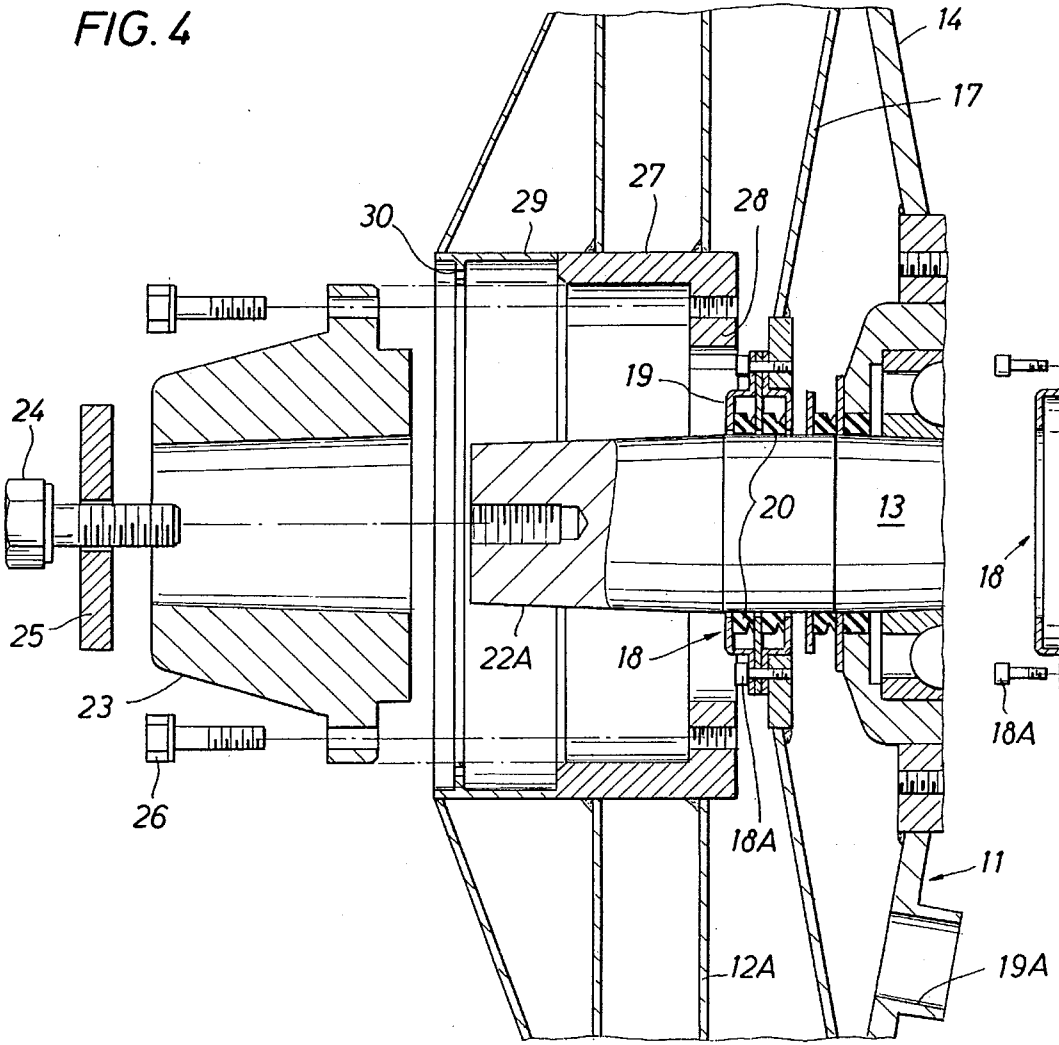
FIG. 4 is a view similar to FIG. 3, but upon release of the connection of a bushing to the inner end of the main section of the shaft and the drum to permit it to be removed therefrom.

In accordance with the present invention, the seal assembly 18 is such size that it may pass through the smallest diameter portion of the opening in the drum end wall and thus, in the illustrated construction of the drum, through the inner diameter of the flange 28 of the sleeve ring 27. In order to remove the seal assembly for replacement or repair, the bolts 32 are first released to permit the cover 31 to be removed from across the opening through the left end wall of the drum, as illustrated in FIG. 3. Then, as illustrated in FIG. 4, the bolts 26 may be released from the ring 27, and the bolt 24 released from the inner end of the main shaft section 22, whereby the plate 25 and the bushing may also be removed from within the access opening in the left end wall of the drum.

Figure 5:
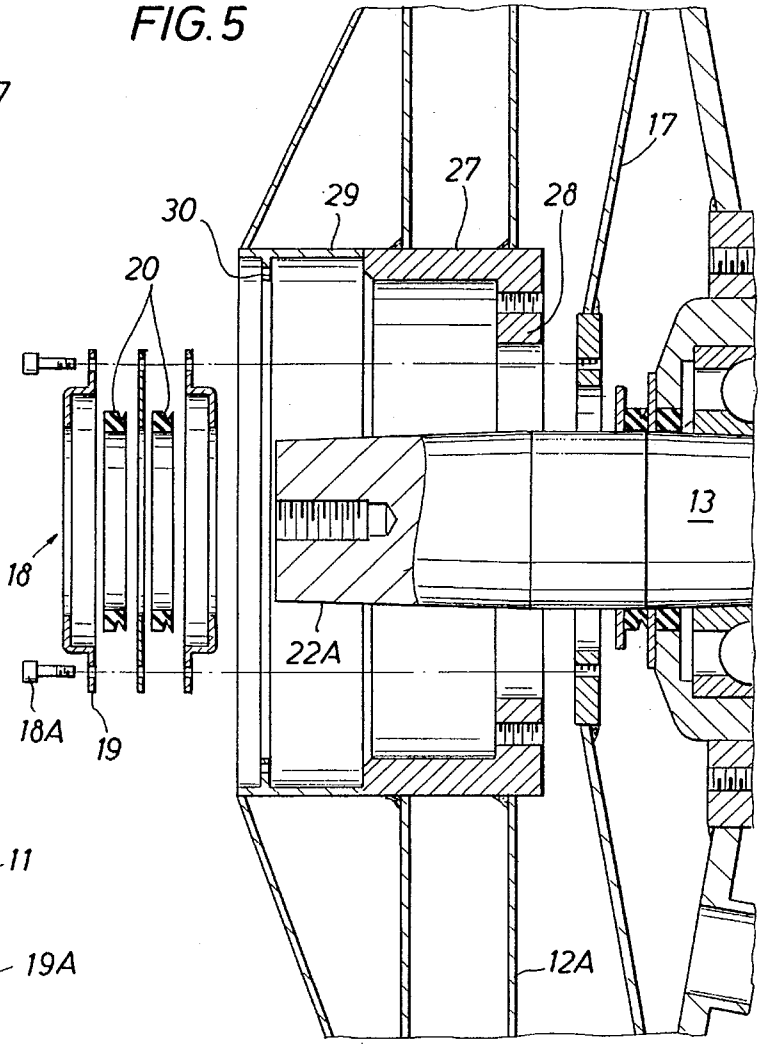
FIG. 5 is a view similar to FIG. 4, but upon release of the seal assembly from connection to the end wall of the shell to permit the seal assembly to be removed through the opening in the end of the drum.

At this time, and as shown in FIG. 5, the bolts 18A may be released from the inner periphery of the inner wall 17 of the shell to permit the seal assembly to be removed from the shell and through the opening in the end wall of the drum, whereby they may be replaced or repaired through the access openings in the left-hand ends of the drum and shell. Obviously, the seal assembly, adapter and cover may be reconnected in reverse order to that above described in order to again prepare the machine for further operation with the replaced or repaired seal assembly.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A textile treating machine, comprising a frame, a drum for receiving textiles to be treated as well as treatment liquid and having a shaft, a bearing assembly mounted on the frame and supporting the shaft for rotation, means for so rotating the shaft and thus the drum to cause the liquid to be circulated through the textiles, a seal assembly releasably connected to the frame and including at least one seal ring sealably surrounding the shaft inboard of the bearing assembly, said drum having an opening in one end surrounding the shaft of a size to pass the seal assembly therethrough and an access opening in its other end, said shaft including a main section which extends through the seal and bearing assemblies and a bushing releasably connected over a tapered inner end of the main section of the shaft and to the drum, the connections of the bushing to the main shaft section and drum and the seal assembly to the frame being accessible from within the drum to permit them to be replaced through the access opening in the other end of the drum without removal of either of the bearing assembly or main shaft section.

2. A textile treating machine, comprising an outer shell in which textile treating liquid may be contained and having an opening in one end, a perforated drum for receiving textiles to be treated and having a shaft extending through the shell opening, a bearing assembly mounted on the shell and supporting the shaft for extension therethrough, means for rotating the shaft and thus the drum within the shell so as to cause the liquid to be circulated through the textiles, a seal assembly releasably connected on the shell and including at least one seal ring sealably surrounding the shaft inboard of the bearing assembly so as to prevent leakage of the liquid from the shell, said drum having an opening in one end surrounding the shaft and of a size to pass the seal assembly therethrough, said shaft including a main section which extends through the seal and bearing assemblies and a bushing releasably connected over an inner end of the main section and to the drum, the shell and drum having access openings in their other ends, and the connections of the bushing to the main shaft section and drum and the seal assembly to the shell being accessible from within the drum to permit them to be replaced through the access openings in the other ends of the shell and drum without removal of either of the bearing assembly or main shaft section.

* * * * *